US005327680A

United States Patent [19]

Miller

[11] Patent Number: 5,327,680

[45] Date of Patent: Jul. 12, 1994

[54] ADJUSTABLE FASTENING DEVICE FOR SECURING A SENSING EDGE TO ANY OF A PLURALITY OF DOORS

[75] Inventor: Bearge D. Miller, Concordville, Pa.

[73] Assignee: Miller Edge, Inc., Concordville, Pa.

[21] Appl. No.: 54,809

[22] Filed: Apr. 29, 1993

[51] Int. Cl.[5] ..... E05F 15/02

[52] U.S. Cl. ..... 49/27; 49/482.1; 49/493.1; 49/506; 200/61.43

[58] Field of Search ..... 49/27, 482.1, 493.1, 49/506; 200/61.43

[56] References Cited

U.S. PATENT DOCUMENTS

| | | | |
|---|---|---|---|
| 3,250,040 | 5/1966 | Squires | 49/482.1 |
| 3,462,885 | 8/1969 | Miller | 49/27 X |
| 4,051,336 | 9/1977 | Miller | 49/27 X |
| 5,027,552 | 7/1991 | Miller et al. | 49/27 |
| 5,124,511 | 6/1992 | Miller et al. | 200/61.43 |

*Primary Examiner*—Philip C. Kannan

*Attorney, Agent, or Firm*—Panitch Schwarze Jacobs & Nadel

[57] ABSTRACT

A fastening device for securing a sensing edge to a door edge includes a mounting plate having a first surface facing the door edge and a second surface facing the sensing edge. At least three elongated clamping members are spaced from each other and extend from the mounting plate. At least two of the clamping members are detachable at notches provided to facilitate such detachment. Thus, the fastening device is adaptable to receive one of a plurality of different thickness door edges facing the first surface. The sensing edge detects objects in proximity to the door edge and includes a switch for activating an electrical device upon compression of an elongated outer sheath. The sensing edge is releasably mounted to the second surface of the mounting plate by male and female interconnecting members. Alternatively, the sensing edge is permanently mounted directly to the second surface of the mounting plate.

18 Claims, 2 Drawing Sheets

ADJUSTABLE FASTENING DEVICE FOR SECURING A SENSING EDGE TO ANY OF A PLURALITY OF DOORS

FIELD OF THE INVENTION

The present invention relates to a sensing edge for controlling the movement of a door by sensing the presence of objects in the path of the door during closing. More particularly, the invention relates to a fastening device for securely fastening such a sensing edge to an edge of a door.

BACKGROUND OF THE INVENTION

In the prior art, sensing edges for doors were permanently attached to the leading edge of the door. Such methods of attachment included the use of adhesives, nails, screws, rivets or the like. These methods are suitable for the purpose intended; however, they have been shown to be troublesome if and when repair or replacement of the sensing edge is required. Since it is or may become necessary to remove a sensing edge from a door in order to repair or replace it, and since the sensing edge was permanently attached to the door, it was difficult to remove the sensing edge without causing damage to the door or the sensing edge itself.

In response to these problems, the assignee of the present invention developed a fastening device, described in U.S. Pat. No. 5,124,511, to act as an intermediary between the edge of the door and the sensing edge. The fastening device described therein is relatively easily securely fastened to the door edge, reducing cost and installation time. Furthermore, since the sensing edge is securely releasably attached to the fastening device and is readily removable, installation, maintenance, and repair are facilitated, promoting additional savings in time and money.

In one embodiment of the above-mentioned fastening device, the device is securely attached to a door edge by means of a mounting plate having elongated clamping members extending from either side. The clamping members are biased inwardly, thereby forming a fastening device having a trihedral cross-sectional shape wherein the distance between the distal ends of the clamping members is less than the width of the door edge to which the fastening device is attached. When the door edge is inserted between the clamping members, the fastening device firmly grips and is secured to the door.

The particular embodiment of the fastening device described above has been successfully manufactured, marketed and installed. However, it presents a disadvantage in that the width of a door edge varies from door to door. As a result, a fastening device that securely grips one door edge may not securely grip another door having a narrower edge. Alternatively, that same device may not be able to contain a third door having a broader edge.

A series of fastening devices of varying widths may be produced to accommodate this problem. However, this requires a manufacturer to make multiple sizes of the same basic design, resulting in additional production costs. Further, an installer of such devices would also incur additional costs in having to inventory and store the multiple sizes. Moreover, the installer may also have the burden of transporting to a work site substantial lengths of multiple sizes of the fastening device, should the need arise. This can become a very cumbersome and expensive task.

The present invention overcomes many of the disadvantages inherent in the above-described fastening device by providing an improvement of the device in which three or more generally parallel elongated clamping members extend from the mounting plate at spaced locations, and where some or all of the clamping members are detachable. By selectively detaching one or more clamping members, an installer may create at the time of installation a fastening device of the proper width for a range of door edges.

The fastening device of the present invention eliminates or significantly reduces the need for producing and stocking multiple sizes of a fastening device. Consequently, the cost and burden of manufacturing, inventorying, storing and transporting the fastening device are significantly reduced, while the advantages of the aforementioned patented device are maintained.

SUMMARY OF THE INVENTION

Briefly stated, the present invention comprises an adjustable fastening device for securing a sensing edge to an edge of a door. The fastening device includes a mounting plate for attachment to the door edge, the mounting plate having a first surface that faces the edge of the door and a second surface that faces the sensing edge. At least three elongated members are spaced from each other and extend from the mounting plate, with at least two of the members able to be selectively detached from the mounting plate. An installer, then, can selectively detach at least one elongated member from the mounting plate and leave two other members remaining. The two remaining members are spaced a predetermined distance from each other so that they are able to receive an edge of a door having a thickness generally corresponding to the predetermined distance. The adjustable fastening device, then, is adaptable to receive any of a plurality of door edges of different thicknesses.

BRIEF DESCRIPTION OF THE DRAWINGS

The foregoing summary, as well as the following detailed description of the preferred embodiments, will be better understood when read in conjunction with the appended drawings. For the purpose of illustrating the invention, there is shown in the drawings embodiments which are presently preferred. It is understood, however, that this invention is not limited to the specific methods and instrumentalities disclosed. In the drawings.

DETAILED DESCRIPTION OF THE PREFERRED EMBODIMENT

Figure 1:
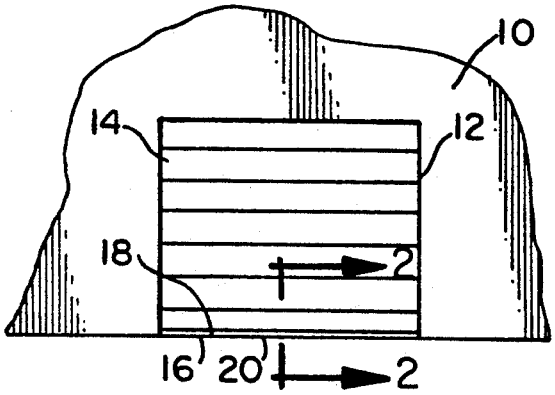
FIG. 1 is an elevational view showing a door construction including a fastening device and a sensing edge in accordance with the present invention.

Certain terminology is used in the following description for convenience only and is not limiting. The words "right", "left", "upper" and "lower" designate directions in the drawings to which reference is made. The words "inwardly" and "outwardly" refer to directions toward and away from, respectively, the geometric center of the fastening device and designated parties thereof. The terminology includes the words above specifically mentioned, derivatives thereof, and words of similar import.

Referring to the drawings in detail, wherein like numerals indicate like elements throughout, there is shown in FIG. 1 a building wall 10 having a doorway 12 provided with a door 14 in a closed position. The door 14, as illustrated, is an overhead door, having a sensing edge 16 secured to the door 14 by means of a fastening device 20 in accordance with the present invention along its lower or leading door edge 18. However, it is within the spirit and scope of the invention to incorporate the sensing edge 16 and fastening device 20 described hereinafter along the leading edge of any door structure, such as vertically disposed or horizontally movable doors, as desired.

In the present embodiment of the invention, the fastening device 20 is elongated and preferably extends along generally the entire width of the leading door edge 18. However, it is to be understood by those skilled in the art that in the alternative a series of two or more separate and shorter fastening devices could be positioned at spaced locations along the leading door edge 18.

Figure 2:
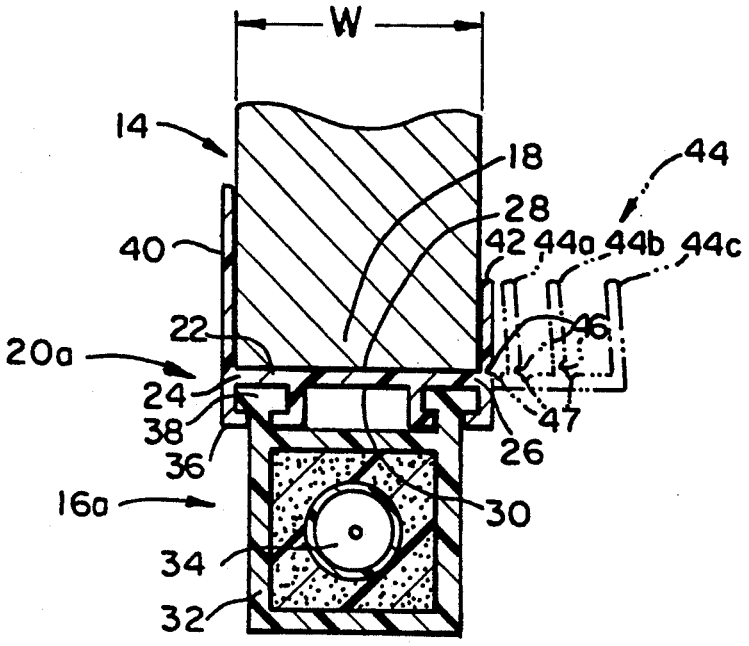
FIG. 2 is a greatly enlarged cross-sectional view taken along line 2—2 of FIG. 1, and shows a first preferred embodiment of the fastening device.
Figure 2A:
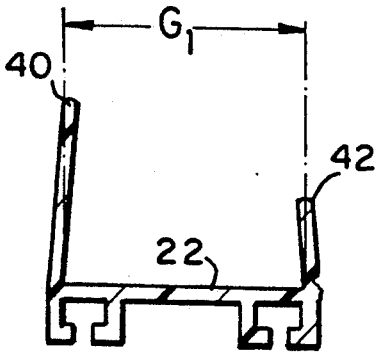
FIGS. 2A through 2D show the fastening device of FIG. 2 with various of the elongated members selectively detached at horizontal and vertical notches.
Figure 2B:
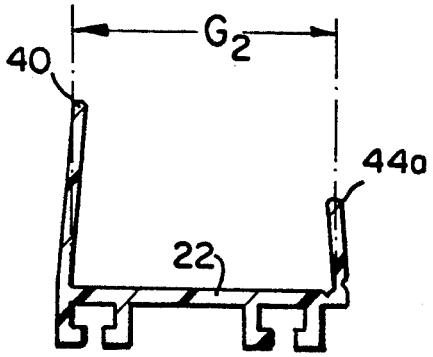
Figure 2C:
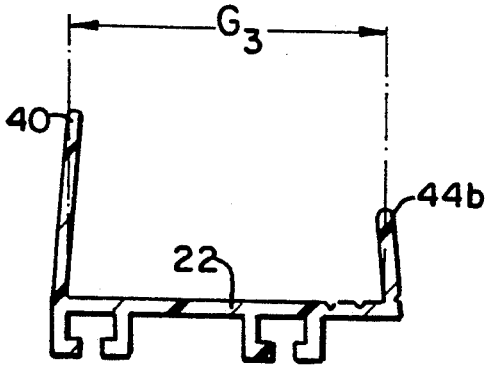
Figure 2D:
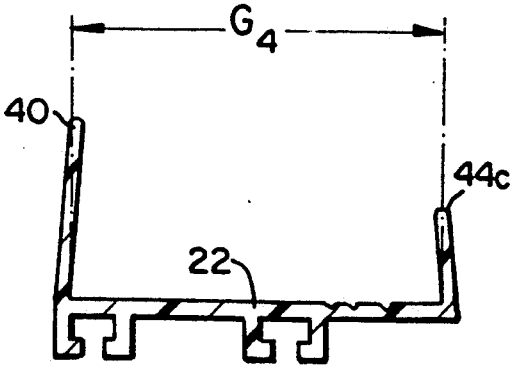

Referring now to FIG. 2, there is shown a fastening device 20*a* in accordance with a first preferred embodiment of the invention. The fastening device 20*a* is an improvement upon a fastening device disclosed in U.S. Pat. No. 5,124,511, hereby incorporated by reference. Fastening device 20*a* is designed so that it may engage and clamp onto the leading door edge 18 without the need for adhesive or any other fastener means which engage or enter the door 14.

The fastening device 20*a* includes a mounting plate 22 for engaging and being attached to the leading door edge 18. The mounting plate 22 has a first or left end 24, a second or right end 26, a door-engaging surface or, in the present embodiment, an upper surface 28, and a surface opposite to the door-engaging surface, in the present embodiment, a lower surface 30. It is to be understood that this directional terminology is specifically applicable to the enlarged partial cross-sectional view in FIG. 2, and that in three dimensions the left and right ends 24 and 26 would be the left and right sides of the mounting plate 22. The mounting plate 22 is generally planar. Therefore, the upper and lower surfaces 28 and 30 preferably extend generally parallel with respect to each other.

The mounting plate 22 has a first elongated clamping member 40 extending from the left end 24. The clamping member 40 may be biased slightly inwardly, forming an angle slightly less than 90° between the first elongated clamping member 40 and the mounting plate 22. This feature is further described in the aforementioned U.S. Pat. No. 5,124,511. A second elongated clamping member 42 extends from the right end 26 of the mounting plate 22, and may also be biased slightly inwardly, as with the first elongated clamping member 40. Note, however, that the bias is not shown in FIG. 2 with respect to members 40 or 42 since door edge 18 is positioned therebetween.

Additionally, as is shown in FIG. 2, the first preferred embodiment has at least one other elongated clamping member 44 extending from the right end 26 of the mounting plate 22. Three such other clamping members 44*a*, 44*b*, and 44*c* are shown in FIG. 2. The clamping member(s) 44, like members 40 and 42, may be biased slightly inwardly. Regardless of whether any or all of the elongated clamped members 40, 42 or 44 are biased inwardly, all of the elongated clamping members extend generally upwardly from the upper surface 28 of the mounting plate 22 in a generally parallel fashion, with elongated clamping members 40, 42 and 44 spaced predetermined distances from each another.

Preferably, the fastening device 20*a* is constructed as one continuous piece containing the mounting plate 22, the first elongated clamping member 40, the second elongated clamping member 42, and the clamping member(s) 44, from a polymeric material such as polyvinylchloride. However, it is understood by those skilled in the art that other materials of a similar character could be used to fabricate the fastening device 20*a*. Preferably, the fastening device 20*a* is fabricated by an extrusion process. However, it is understood by those skilled in the art that other fabrication methods could be used.

Preferably, the fastening device 20*a* contains elongated vertical and horizontal notches or grooves 46 and 47. In the first preferred embodiment, the notches 46 and 47 are located at the juncture of the mounting plate 22 and each of the clamping members 42 and 44, except for the right-most clamping member 44. The notches 46 and 47 facilitate the removal of unwanted clamping members 42 or 44. The use of the notches 46 and 47 will be explained below.

An installer installing the fastening device 20*a* onto the leading door edge 18 of a door 14 does so by the following method.

Preliminarily, the installer determines the width or thickness W of the leading door edge 18. The thickness W generally establishes the size of the gap that must be created between the elongated members on the left and right ends 24 and 26 of the mounting plate 22.

The installer creates a gap of approximately thickness W by selectively detaching elongated members 42 or 44 at their respective vertical notches 46. The gap is created between the first elongated member 40 on the left end 24 of the mounting plate 22 and the closest remaining elongated member 42 or 44 on the right end 26. The gap is the proper width when the leading door edge 18 can be inserted between clamping members 40 and 42 or 44, and the aforementioned clamping members act to engage and firmly grip the door edge 18 and securely attach the fastening device 20*a* to the door edge 18.

After the proper-size gap has been created, extra clamping members 44 may remain to the right of the elongated member 42 or 44 forming the right side of the gap. The extra clamping members 44 may also be selectively detached from the mounting plate 22 at the first horizontal notch 47 to the left of the left-most extra member 44.

FIGS. 2A through 2D show the fastening device 20 of FIG. 2 with various of the elongated members 42 or 44 selectively detached. As is evident, gaps of varying width $G_1$–$G_4$ may be created by detaching members 42 and/or 44 at their respective vertical notches 46. Additionally, unused and unnecessary members 44 may also be detached by severing the excess members at the proper horizontal notch 47.

Preferably, the notches 46 and 47 are constructed to allow the selective detachment of various of the clamping members 42 or 44 with relative ease, while still providing sufficient structural integrity overall so that the remaining clamping members may securely and firmly grip the door edge 18. Preferably, the polymeric material comprising the fastening device 20 is readily cuttable. As a result, an elongated member 42 or 44 may be removed by drawing a sharp knife or blade across the proper notch, thus detaching the selected member. Alternatively, the notches 46 and 47 may be constructed to allow for detachment when pressure is applied by the installer in the proper location. It can be appreciated by those skilled in the art that the present invention is not limited to any particular method for removing elongated members.

Once the fastening device 20*a* has been properly fashioned, an installer installs the device 20*a* by inserting the door edge 18 between the clamping members 40 and 42 or 44 that define the gap. It is intended that a fastening device 20*a* constructed in accordance with this invention may firmly grip and secure itself to a door edge 18 without the use of adhesives, nails, screws, or other attaching aids. However, it can be appreciated by one skilled in the art that such aids may still be used at the discretion of the installer.

With the fastening device 20*a* mounted to the door edge 18, a sensing edge 16*a* may be secured to the mounting plate 22 of the fastening device 20*a*, and thus to the door edge 18. A single fastening device 20*a*, then, is able to accommodate door edges 18 of varying widths merely by the selective detachment of the elongated members extending from the mounting plate 22 of the device 20*a*.

The sensing edge 16*a* attached to the fastening device 20*a*, as shown in FIG. 2, is used to detect objects in proximity to the leading door edge 18. The sensing edge 16*a* includes an elongated sheath 32 fabricated of a form-retaining flexible air-impervious material such as rubber. The sheath 32 is compressible upon the application of an external pressure or force. Located within the sheath 32 is a switch means 34 which actuates an electrical circuit (not shown) upon compression of the sheath 32, as is understood by those skilled in the art. Thus, when an object in proximity to a closing leading door edge 18 causes a compressive force to be applied to the sensing edge 16*a*, the switch means 34 actuates the circuit to either stop the door 14 from moving further or to return the door 14 to the open position. It is understood by those skilled in the art that the present invention is not limited to any particular switch means 34 or sensing edge 16*a*. For instance, the switch means and/or sensing edge could be of the type disclosed in U.S. Pat. Nos. 3,462,885; 4,785,143; 4,908,483; 4,920,241; or 5,225,640, all of which are hereby incorporated by reference.

As shown in FIG. 2, sensing edge 16*a* is interconnected with fastening device 20*a* by a securing means which releasably secures the sensing edge 16*a* to the mounting plate 22. The securing means comprises at least one female member 36 which may extend outwardly from the lower surface 30 of the mounting plate 22, and at least one complementary male member 38 which may extend outwardly from the sheath 32 of the sensing edge 16*a*. Note that in FIG. 2 two pairs of male and female members 36 and 38 are present. The male member 38 is releasably positioned within the female member 36 such that the sensing edge 16*a* is securely attached to but readily removable from the mounting plate 22.

A more detailed discussion of the interconnection of the sensing edge 16*a* to the mounting plate 22 by means of male and female members is disclosed in U.S. Pat. No. 5,124,511. It should be noted that the present invention is not limited to any particular securing means, and that the means described here are merely illustrative.

Figure 3:
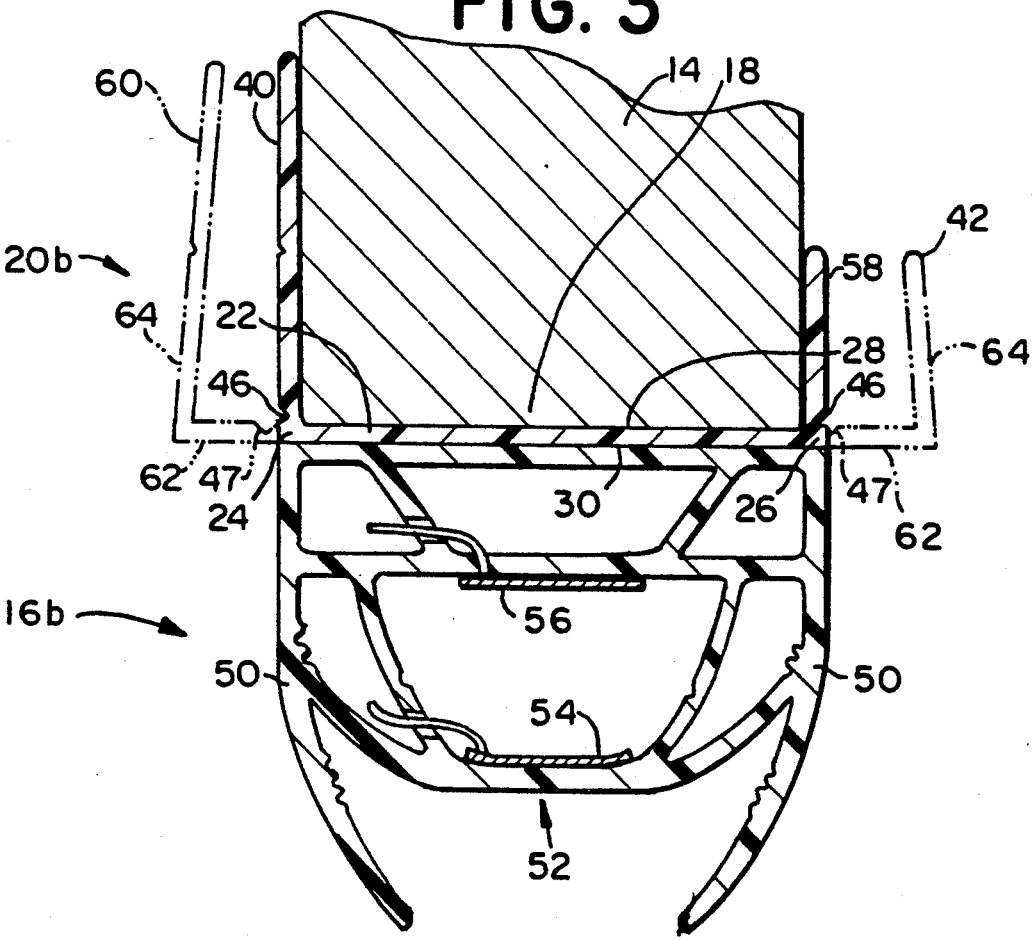
FIG. 3 is a greatly enlarged partial cross-sectional view of the fastening device of FIG. 1 in accordance with the second preferred embodiment.

Referring now to FIG. 3, there is shown another fastening device 20*b* in accordance with a second preferred embodiment of the invention. In the second preferred embodiment, multiple elongated clamping members extend upwardly from both the left and right ends 24 and 26 of the mounting plate 22.

As with the first preferred embodiment, a first elongated clamping member 40 extends from the left end 24 of the mounting plate 22. Also as before, a second elongated clamping member 42 extends from the right end 26. The second elongated clamping member 42 is spaced a first predetermined distance away from the first elongated clamping member 40. Thus, a first door edge 18 having a thickness corresponding to the first predetermined distance may be inserted in a gap created between the first and second elongated members 40 and 42.

The second preferred embodiment has a third elongated clamping member 58. The third elongated clamping member 58 extends from the right end 26 of the mounting plate 22, and in FIG. 3 is positioned between the first and second members 40 and 42. The third member 58, then, is spaced a second predetermined distance from the first member 40. Accordingly, a second door edge 18 having a thickness corresponding to the second predetermined distance may be inserted in a gap created between the first and third members 40 and 58.

The second preferred embodiment of the preferred invention also has a fourth elongated clamping member 60. The fourth member 60 extends from the left end 24 of the mounting plate 22 and is spaced a third predetermined distance from the second member 42. As may be expected, a third door edge 18 having a thickness corresponding to the third predetermined distance may be inserted in a gap created between the second and fourth members 42 and 60.

Additionally, the fourth member 60 is spaced a fourth predetermined distance from the third member 58, and a fourth door edge 18 having a thickness corresponding to the fourth predetermined distance may be inserted in a gap created between the fourth and third members 60 and 58.

By extension, a fifth elongated clamping member (not shown) could extend from the right end 26 of the mounting plate 22. Such a fifth member would be spaced a fifth predetermined distance from the first elongated clamping member 40 and a sixth predetermined distance from the fourth elongated clamping member 60. Thus, the fastening device 20*b* could accommodate fifth and six door edges 18 having thicknesses which correspond to the fifth and sixth predetermined distances.

As is evident, then, sixth, seventh, eighth, etc. elongated clamping members could also extend from either the left or right end 24 or 26 of the mounting plate 22. The additional members would be spaced apart from several other elongated members several more predetermined distances for receiving a plurality of door edges 18 having thicknesses which correspond to the several more predetermined distances.

The manner of measuring the width W of a door edge 18, creating a gap of the proper width, and attaching the fastening device 14 to the door 14 are substantially the same as with the first preferred embodiment, and will not be described further.

It is readily understood that the creation of a proper-size gap between specific members may require the removal of other obstructing members. As with the first preferred embodiment, elongated notches 46 and 47 are included in the second preferred embodiment to facilitate the removal of any unnecessary members or members that are obstructing a desired gap. Thus, a knife or blade may be used to cut such member(s) off at the proper notches 46 and/or 47. For example, if the fourth predetermined distance between the fourth and third elongated members 60 and 58 (as shown in FIG. 3) is desired, the first member 40 would be removed at the notch 46 at the juncture of mounting plate 22 and member 40. Additionally, the second member 42 could be removed at the notch 47 at the juncture of mounting plate 22 and third member 58.

It is to be understood that, as with the first preferred embodiment, each elongated clamping member 40, 42, 58 and 60 may be biased slightly inwardly. It is also to be understood that for the second and fourth elongated clamping member 42 and 60 of the second preferred embodiment to extend outwardly from the left or right end 24 or 26 of mounting plate 22, as is shown in FIG. 3, each member includes a first leg 62 extending in a generally parallel fashion from and with respect to mounting plate 22, and a second leg 64 extending in a generally perpendicular fashion from and with respect to the first leg 62. Thus, members 42 and 60, each comprised of first and second legs 62 and 64, are generally L-shaped when viewed in a cross-sectional fashion. The same is true with respect to the additional member(s) 44 in the first preferred embodiment.

Note that in FIG. 3, another sensing edge **16*b* is displayed. Sensing edge 16*b* is described in detail in the above-referenced U.S. Pat. No. 5,225,640. Generally, the sensing edge 16*b* has an outer sheath 50 and an inner structure 52. The inner structure 52 flexibly supports lower switch contact 54 and upper switch contact 56. The sensing edge 16*b* detects an object obstructing door edge 14 when enough pressure is exerted to urge lower switch contact 54 and upper switch contact 56** to meet.

As is shown in FIG. 3, sensing edge **16*b* may be mounted directly to the lower surface 30 of the mounting plate 22. In such a situation it is preferable that the sensing edge 16*b* and the fastening device 20*b* be coextruded such that the upper surface of the sensing edge 16*b* is bonded directly to the lower surface 30 of the mounting plate 22. It is also preferred that the mounting plate 22 and the outer sheath 50 be formed from compatible materials which, upon the application of heat and pressure during the coextrusion process, form bonds to securely attach the sheath 50 to the mounting plate 22. It is preferred that the sheath 50 be formed from an elastomeric material, and more preferably from "SANTOPRENE" 101-55, which is commercially available from Monsanto Company. Alternatively, polyvinylchloride, neoprene, or other elastomers may be used. Also preferably, the fastening device 20*b* is constructed as one continuous piece from a generally rigid polymeric material, such as "SANTOPRENE" 103-50, which is also commercially available from Monsanto Company and which is capable of being coextruded with another material. It is understood and appreciated, however, that the mounting plate 22 may be formed from other materials including those mentioned above, so long as the mounting plate 22 is sufficiently rigid to ensure the structural integrity of the fastening device 20*b* and the sensing edge 16*b***.

The coextrusion process, and the means and method by which lower switch contact 54 and upper switch contact 56 are inserted within the sensing edge **16*b*** during the coextrusion process, are described in detail in the aforementioned U.S. Pat. No. 5,225,640, and will not be described further here.

Note that the fastening devices **20*a* and 20*b* are not intended to be restricted to their respective sensing edges 16*a* and 16*b*, as is shown in FIGS. 2 and 3. It is within the spirit and scope of the present invention that the sensing edge 16*a* portrayed in FIG. 2 may be made to be attached to the fastening device 20*b* shown in FIG. 3**, and vice versa.

Moreover, the manner in which the sensing edge **16*a* is releasably secured to the lower surface 30 of the fastening device 20*a* by way of the female and male members 36 and 38, as shown in FIG. 2, may be equally applied to the sensing edge 16*b* and the fastening device 20*b* of FIG. 3. Furthermore, the manner in which sensing edge 16*b* is directly bonded to the lower surface 30 of the fastening device 20*b* may be equally applied to the sensing edge 16*a* and fastening device 20*a***.

From the foregoing description, it can be seen that the present invention comprises an improvement upon a fastening device for releasably securing or permanently securing a sensing edge to a door edge. It will be appreciated by those skilled in the art, that changes could be made to the embodiments described above without departing from the inventive concepts thereof. It is understood, therefore that this invention is not limited to the particular embodiments disclosed, but is intended to cover all modifications which are within the scope and spirit of the invention as defined by the appended claims.

What is claimed is:

1. An adjustable fastening device for securing a sensing edge to an edge of a door, said fastening device comprising:

a mounting plate for being attached to a door edge and having first and second lateral ends, said mounting plate including a first surface for being in facing relationship with the door edge and a second surface for being in facing relationship with a sensing edge; and at least three elongated members spaced from each other and extending from said mounting plate, at least two of said elongated members being selectively detachable from said mounting plate such that an installer can selectively detach at least one of said detachable elongated members from said mounting plate, at least two remaining elongated members being spaced a distance from each other for receiving an edge of a door having a thickness which generally corresponds to the distance, where the adjustable fastening device is adaptable to receive one of a plurality of different thickness door edges facing the first surface.

2. The fastening device as recited in claim 1 wherein said detachable elongated members include an elongate notch in each detachable elongated member proximate the mounting plate to assist in removing the detachable elongated members from said mounting plate.

3. The fastening device as recited in claim 1 wherein said mounting plate and said elongated members are constructed of a polymeric material which is readily cuttable with a knife.

4. The fastening device as recited in claim 1 further including securing means connected to said second surface of said mounting plate for securing the sensing edge to said mounting plate.

5. The fastening device as recited in claim 1 in combination with a sensing edge releasably secured to the device and facing the second surface of the device.

6. The fastening device as recited in claim 5 further comprising means for releasably coupling the sensing edge to the device.

7. The fastening device as recited in claim 1 mounted to the edge of the door.

8. An adjustable fastening device for securing a sensing edge to an edge of a door, said fastening device comprising:

a mounting plate for being attached to a door edge and having first and second lateral ends, said mounting plate including a first surface for being in facing relationship with the door edge and a second surface for being in facing relationship with a sensing edge;

a first elongated member extending from said mounting plate proximate said first end thereof;

a second elongated member extending from said mounting plate proximate said second end thereof and being detachable from said mounting plate, said first elongated member being spaced apart from said second elongated member a first predetermined distance for receiving an edge of a first door having a thickness which corresponds to the first predetermined distance between the first and second elongated members; and a third elongated member extending from said mounting plate proximate said second end thereof between said first and second elongated members and being detachable from said mounting plate, said first elongated member being spaced from said third elongated member a second predetermined distance for receiving an edge of a second door having a thickness which corresponds to the second predetermined distance between the first and third elongated members, where an installer can selectively detach one of said second and third elongated members from said mounting plate such that the first elongated member and the other of the second and third elongated members are spaced a selected distance for receiving an edge of a door having a thickness which corresponds to the selected distance, and where the adjustable fastening device is adaptable to receive one of a plurality of different thickness door edges.

9. The fastening device as recited in claim 8, where said detachable elongated members include an elongated notch in each detachable elongated member proximate the mounting plate to assist in removing the detachable elongated members from said mounting plate.

10. The fastening device as recited in claim 8 where said second elongated member includes a first leg extending from the mounting plate generally parallel thereto and a second leg extending from said first leg such that the second elongated member is generally L-shaped in cross section.

11. The fastening device as recited in claim 8 further including securing means connected to said second surface of said mounting plate for securing the sensing edge to said mounting plate.

12. The fastening device as recited in claim 8 further including a fourth elongated member extending from said mounting plate proximate said first end thereof, said fourth elongated member being spaced from said second elongated member a third predetermined distance for receiving an edge of a third door having a thickness which corresponds to the third predetermined distance between the second and fourth elongated members, said fourth elongated member being spaced from said third elongated member a fourth predetermined distance for receiving an edge of a fourth door having a thickness which corresponds to the fourth predetermined distance between the third and fourth elongated members, where an installer can selectively detach two of the elongated members from the mounting plate such that the other two elongated members are spaced a selected distance for receiving an edge of a door having a thickness which corresponds to the selected distance between the other two elongated members.

13. The fastening device as recited in claim 8 wherein said mounting plate and first, second and third elongated members are constructed of a polymeric material which is readily cuttable with a knife.

14. The fastening device as recited in claim 8 in combination with a sensing edge releasably secured to the device and facing the second surface of the device.

15. The fastening device as recited in claim 8 further comprising means for releasably coupling the sensing edge to the device.

16. The fastening device as recited in claim 8 mounted to the edge of the door.

17. A method for mounting a sensing edge to an edge of a door, the sensing edge causing a closing door to open by actuation of a device upon force being applied to the sensing edge, said method comprising the steps of:

determining a thickness of an edge of a door upon which the edge is to be mounted;

selectively detaching at least one elongated member from a mounting plate for a sensing edge having at least three spaced elongated members such that two elongated members extend from said mounting plate and are spaced a distance from each other which corresponds to the thickness of the door edge;

positioning the mounting plate on said door edge with said edge of said door complementarily positioned between said two elongated members.

18. The method as recited in claim 17 further comprising the step of:

mounting the sensing edge to the mounting plate.

* * * * *